US011745986B2

(12) United States Patent
Iotti

(10) Patent No.: US 11,745,986 B2
(45) Date of Patent: Sep. 5, 2023

(54) ARM WITH TWO OR MORE HOOKS

(71) Applicant: MANITOU ITALIA S.R.L., Castelfranco Emilia (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 341 days.

(21) Appl. No.: 16/931,776

(22) Filed: Jul. 17, 2020

(65) Prior Publication Data

US 2021/0024332 A1 Jan. 28, 2021

(30) Foreign Application Priority Data

Jul. 25, 2019 (IT) ..... 102019000012957

(51) Int. Cl.

| | |
|---|---|
| ***B66C 1/40*** | (2006.01) |
| ***B66C 13/16*** | (2006.01) |
| ***B66C 1/34*** | (2006.01) |
| ***B66C 1/36*** | (2006.01) |

(52) U.S. Cl.

CPC ..... *B66C 1/40* (2013.01); *B66C 1/34* (2013.01); *B66C 1/36* (2013.01); *B66C 13/16* (2013.01)

(58) Field of Classification Search

CPC .. B66C 1/34; B66C 1/40; B66C 1/105; B66C 13/16; B66F 9/0655; B66F 17/00; B66F 17/003; B66F 17/17006

USPC ..... 294/81.56

See application file for complete search history.

(56) References Cited

U.S. PATENT DOCUMENTS

| | | | | |
|---|---|---|---|---|
| 2,314,792 | A * | 3/1943 | Korner | B66F 9/12 414/785 |
| 4,037,469 | A * | 7/1977 | Nordstrom | G01G 19/14 177/244 |
| 4,969,789 | A * | 11/1990 | Searle | E04G 21/22 294/81.61 |
| 5,209,361 | A * | 5/1993 | Grubb, Jr. | B66C 13/16 212/250 |
| 6,092,911 | A | 7/2000 | Baker, III et al. | |
| 6,517,131 | B1 * | 2/2003 | Haataja | B66C 23/36 212/242 |
| 2011/0127477 | A1 * | 6/2011 | Kokolis | B66D 1/26 254/338 |
| 2016/0287918 | A1 | 10/2016 | Huehn | |

FOREIGN PATENT DOCUMENTS

| | | |
|---|---|---|
| CN | 206553065 U | 10/2017 |
| SU | 404757 A1 | 10/1973 |

OTHER PUBLICATIONS modulift.com; "Load Monitoring Spreader Beam", Oct. 24, 2018; pp. 1-8; XP002798436.

(Continued)

*Primary Examiner* — Dean J Kramer

(74) *Attorney, Agent, or Firm* — Pearne & Gordon LLP; J. Gregory Chrisman

(57) ABSTRACT

The arm with two or more hooks 1 comprises: a supporting beam 1) designed to be connected to an operating arm 20 of a telehandler 2 or another self-propelled operating machine and a plurality of hooks 11, 12, 13, distributed along the beam 10, each designed for supporting a respective load. One or more hooks 11, 12, 13 are connected to a load sensor 31, 32, 33.

20 Claims, 4 Drawing Sheets

(56) References Cited

OTHER PUBLICATIONS

Ministero Dello Sviluppo Economico, "Rapporto di Ricerca" and "Opinione Scritta", Mar. 23, 2020, p. 1-7.
Russian Office Action and Search Report dated Jun. 6, 2022 in corresponding Russian Patent Application No. 2020124182/11(041740), 6 pages.

* cited by examiner

ARM WITH TWO OR MORE HOOKS

This invention relates to an improved arm with two or more hooks, designed to be used as equipment on telehandlers or other self-propelled operating machines.

There are prior art arms with two or more hooks which have a plurality of hooks distributed along the respective supporting beam, designed to be cantilever mounted on the distal end of the telescopic operating arm of a telehandler.

Each hook is designed to support a respective load, with a different weight from that of the other hooks, for example 25 tonnes instead of 13 tonnes or 18 tonnes and so on.

Although the prior art arms with two or more hooks are very useful equipment for certain applications, they are not, however, without limits. For example, it may happen that the operator estimates incorrectly the weight of a load to be lifted or confuses which is the correct hook to be used for a certain weight, with the consequence of attaching the load to a hook set up to bear a lower weight; in these circumstances, there is a risk of detachment of the load from the arm during lifting or damage to the arm. Moreover, it often happens that a very bulky load is connected to the arm by attaching it to two hooks, for example by a chain; in effect, if the load weighs 18 tonnes and is, for example, quite long, such as a concrete pipe, it can be hung simultaneously from a 25 tonne hook and a 13 tonne hook. However, since in certain circumstances it is not easy for the operator to estimate where the barycentre of the load is located, it may happen that a load connected to two hooks bears more on the hook set up to support the minor weight, which may result in the same consequences indicated above for the incorrect estimation of the load and for the mistake in the hook to be used.

The technical purpose which forms the basis of the invention is therefore to propose an arm with two or more hooks and a method for using an arm with two or more hooks which is able to overcome the limitations of the prior art.

Further features and advantages of the invention are more apparent in the detailed description below, with reference to a preferred, non-limiting, embodiment of an arm with two or more hooks according to the invention as illustrated in the accompanying drawings, in which.

Figure 1:
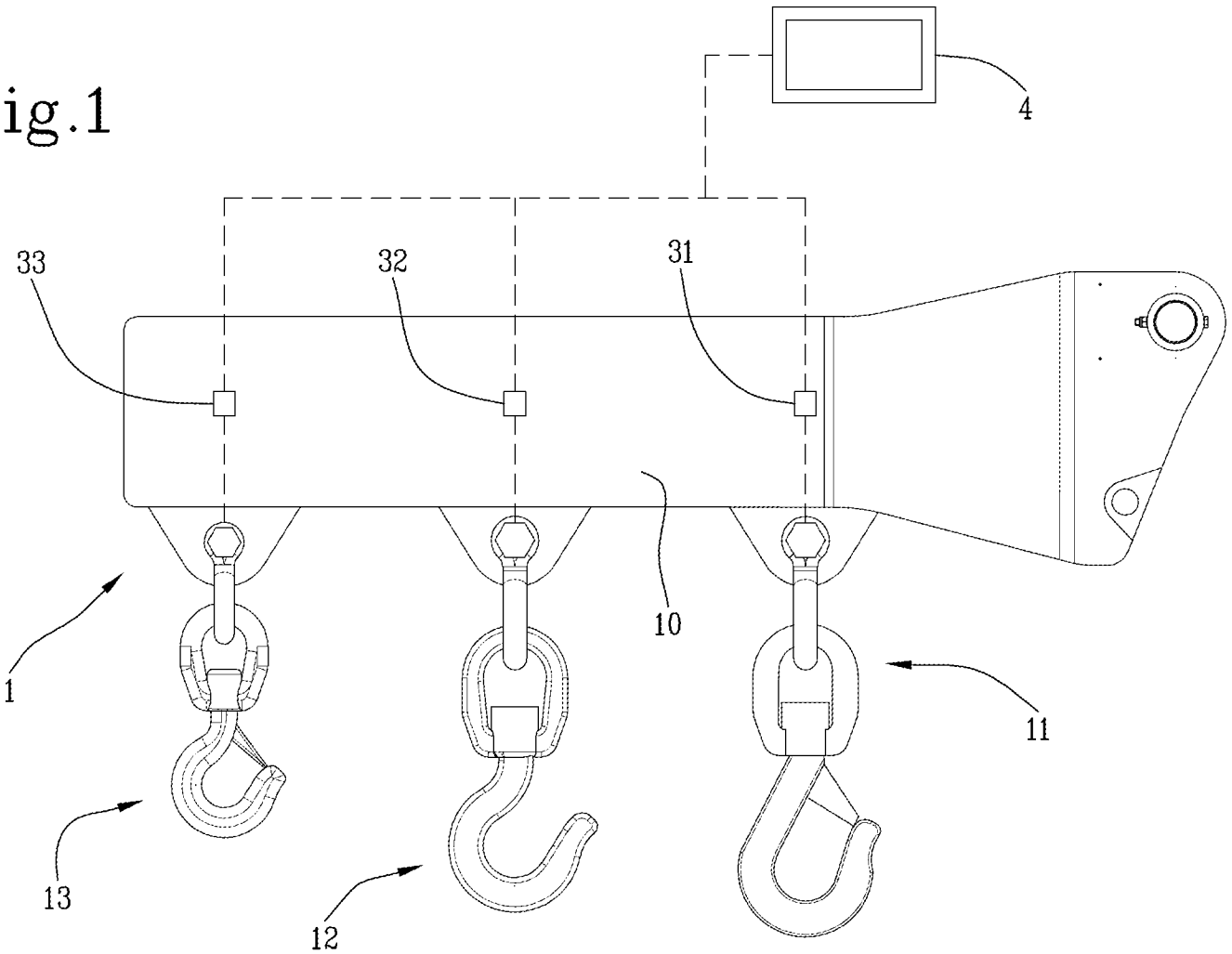
FIG. 1 is a side view of an arm according to the invention.

With reference to the accompanying drawings, the numeral 1 denotes an arm with two or more hooks made according to the invention.

The proposed arm 1 includes a supporting beam 10 designed to be connected to the coupling device 21 with which the distal end of the operating arm 20 of a telehandler 2 is equipped.

As shown in FIG. 1, the beam 10 is equipped, distributed along its length and at its lower side, with several hooks 11, 12, 13, each set up to support a respective load, that is to say, a respective maximum weight value of the load.

More in detail, the maximum weight which can be supported by one of the hooks 11, 12, 13 is different from that of the other two and, typically, decreases as the hook moves towards the distal end; for example, in the case of arms with three hooks 1 such as that shown in the drawings, the innermost hook could support 25 tonnes, the intermediate 18 tonnes and the outermost 13 tonnes (which are clearly example values).

Figure 2:
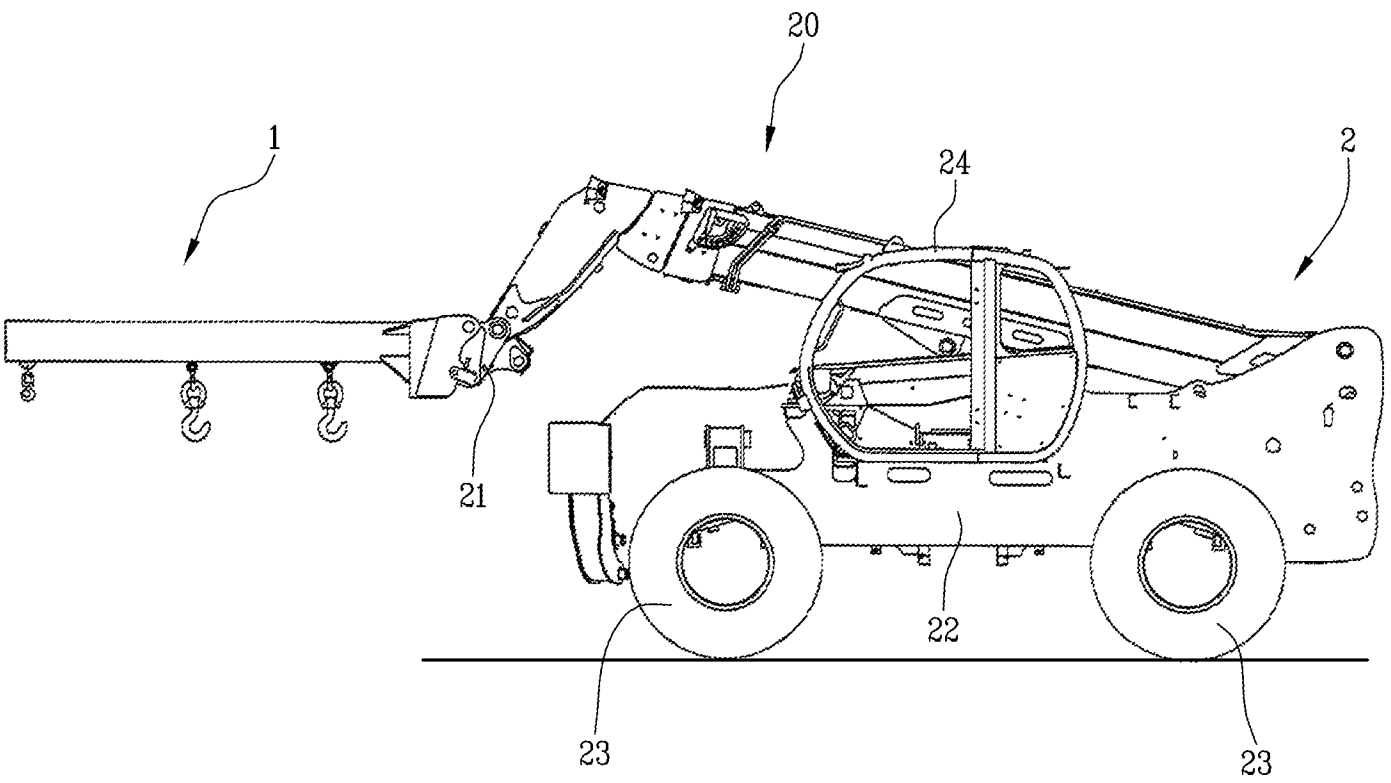
FIG. 2 is a side view of a telehandler which mounts the proposed arm.

According to an important aspect of the invention, shown schematically in FIG. 2, a relative load sensor is connected to at least one of the hooks 11, 12, 13, but preferably to all the hooks 11, 12, 13.

More in detail, as schematically shown in FIG. 1, each hook 11, 12, 13 may be connected to a respective load sensor 31, 32, 33 which measures the weight of the load which is supported by the hook 11, 12, 13 and consequently produces a load signal representing the measurements taken.

The sensors 31, 32, 33 are preferably included in the beam 10 or are positioned between beam 10 and hooks 11, 12, 13.

In practice, the arm with two or more hooks 1 according to the invention is able to measure the weight which actually bears on each of the hooks 11, 12, 13 and this allows it to overcome all the limitations of the prior art, as will be clearly explained in the description of the operation of the invention. The invention is also configured as a fastening system for telehandlers or other self-propelled operating machines, which, as well as comprising the arm with two or more hooks 1 proposed, also includes an electronic processing unit 4 connected to the load sensors and designed to receive and process the above-mentioned load signals.

In the present description, the electronic processing unit 4 will be presented as being subdivided into separate functional modules solely for the purpose of describing the functions clearly and completely.

In practice, such processing unit 4 may be constituted by a single electronic device, if necessary also of the type commonly present on this type of machine, suitably programmed to perform the functions described; the various modules can correspond to hardware units and/or software routines forming part of the programmed device.

Alternatively or in addition, the functions can be performed by a plurality of electronic devices on which the above-mentioned functional modules can be distributed.

In general, the processing unit 4 may have one or more microprocessors or microcontrollers for execution of the instructions contained in the memory modules and the above-mentioned functional modules may also be distributed on a plurality of local or remote calculators based on the architecture of the network in which they reside.

Thanks to the use of the sensors 31, 32, 33 and the processing unit 4, the invention makes it possible to intervene manually or automatically to avoid the risks illustrated during the discussion of the prior art.

Below, the manual mode of intervention will be described first and then the automatic method, bearing in mind that the use of the two methods and therefore the relative technical details is not mutually exclusive.

First at all, it should be noted that the telehandler 2 for which the invention is intended to be used, includes a frame or carriage 22 carried by driving wheels 23 which directly mounts the driver's cab 24 or mounts a tower or rotary frame on which the cab is located.

Figure 3:
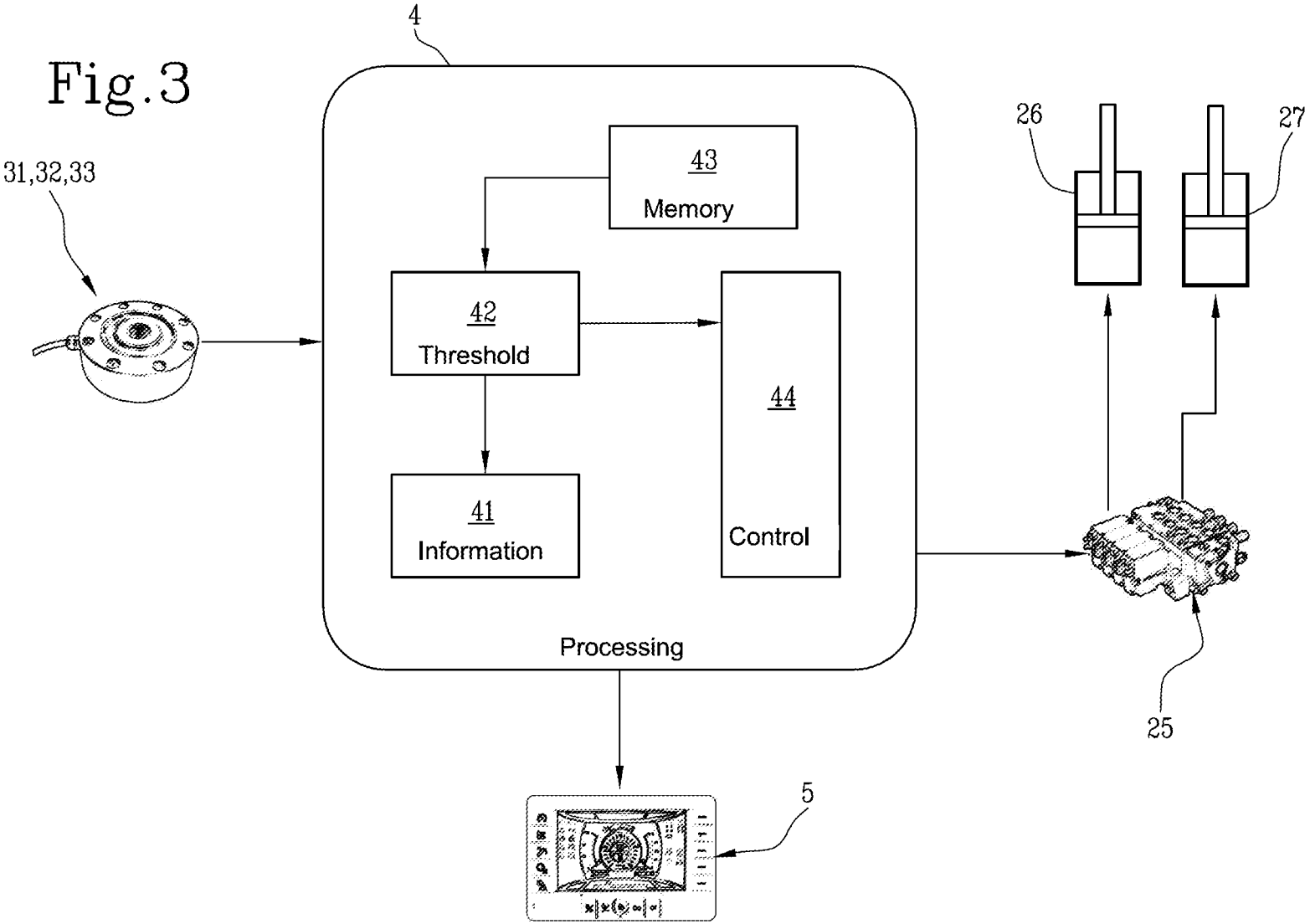
FIG. 3 is a schematic representation of an electronic processing unit according to the invention.
Figure 4:
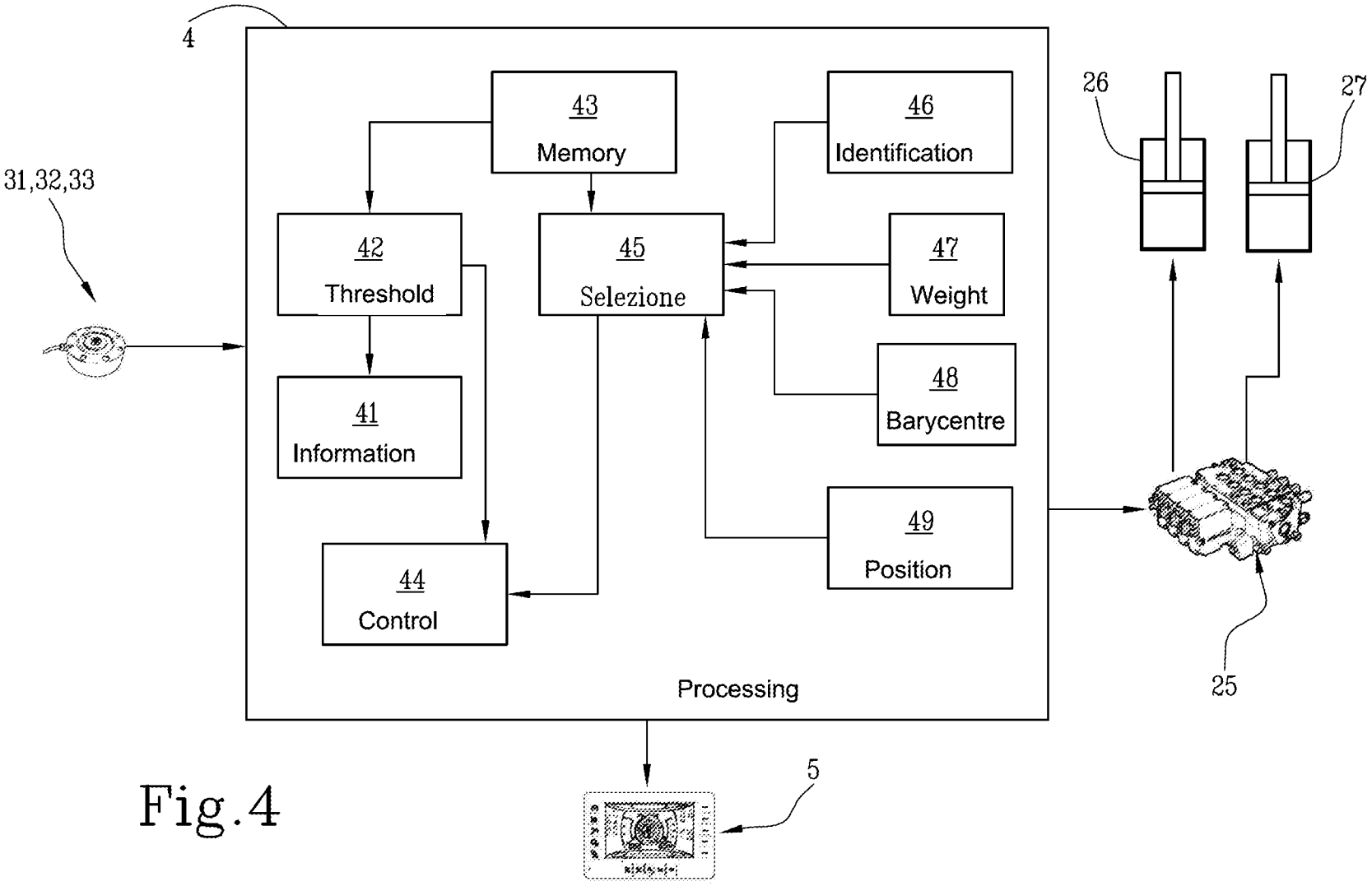
FIG. 4 is a schematic representation of the processing unit according to a specific embodiment.

The telehandler 2 includes an electro-hydraulic distributor 25 which controls the various hydraulic actuators 26, 27 of the invention (see the schematic representation of FIG. 3).

The above-mentioned operating arm 20 is telescopic and is hinged to the carriage 22 or to the tower at its proximal end, whilst at its distal end it is equipped with the coupling device 21, which has already been mentioned above, which allows the removable coupling of the equipment, including the arm 1 according to the invention.

For the purpose of moving the arm 20 there are several hydraulic actuators 26, 27, shown schematically in FIG. 3, connected to the distributor 25, in particular for the lifting and the lowering of the arm, extending and shortening the arm and, if necessary, for the functionality of the apparatus.

To be precise, there is a first actuator 26, preferably a hydraulic cylinder, for the oscillation of the arm 20 about the hinge, that is to say, for the lowering and the lifting.

Moreover, inside the segments slidably inserted one in the other which define the telescopic arm 20, there is at least a second elongation/retraction actuator 27, connected to the segments, which preferably consists of a hydraulic cylinder.

Inside the cab 24 there are the commands, of per se known type, with which the operator can control both the translation of the vehicle 2 and the movements of the operating arm 20, acting on the hydraulic distributor 25 which receives the electrical control signals from the commands.

The invention may include a communication device 5 connected to the processing unit 4 and designed to provide to the operator with information relative to the loads supported by the arm 1.

In practice, in the cab 24 of the telehandler 2 or on a mobile device available to the operator, such as a remote control, there may be an interface or other means designed to communicate information which allow the operator to know the actual weight which bears on a specific hook of the arm 1.

Consider, for example, a display unit 5 where numerical or graphical indexes allow the operator to understand which hooks 11, 12, 13 are engaged and with what weight, as well as other information such as the maximum load which can be supported by each hook or other information; moreover, it is also possible that this communication device 5 is able to produce other visual or audio signals to make known to the operator the operating condition of the arm 1.

The processing unit 4 then comprises an information module 41 which is configured for producing information signals which are a function of the measurements of the above-mentioned sensors 31, 32, 33.

These signals are designed to control the communication device 5, for example the above-mentioned display, in such a way that they show the operator the load data measured using the sensors 31, 32, 33.

This first type of operation of the system according to the invention may allow the operator to immediately understand if an error has been made in estimating the load which must be attached to a certain hook 11, 12, 13 or if hook for a load of a certain weight has been incorrectly identified or if a load has been suspended on two different hooks and the weight bears more on the weaker one.

However, the invention advantageously provides other measures for improving the effectiveness and efficiency of use of the arm with two or more hooks 1.

In fact, the processing unit 4 can comprise a threshold module 42 configured for checking, for one or more hooks 11, 12, 13, whether the load carried by them exceeds or not a respective risk threshold as a function of the maximum weight value which they are designed to support. For example, the threshold may be equal to the maximum weight value which can be supported less a deviation which may be fixed for all the hooks 11, 12, 13 or variable, for example a percentage of the maximum weight or other relation; there could also be a threshold equal to the maximum weight or the upper limit.

There may be other methods for fixing, calculating or parameterising the deviation.

The threshold values and any deviations may be recorded in a memory module 43 of the processing unit 4 which may also include other data, parameters and information used by the modules of the processing unit 4. In any case, the above-mentioned information module 41 may be connected to the threshold module 42 and be therefore configured to produce information signals designed to cause the display 5 (or other information device) to produce alarm messages directed to the operator, if the weight carried by one or more hooks 11, 12, 13 has reached or exceeded the respective risk threshold.

In practice, the operator who is manoeuvring the telehandler 2 in the cab 24 is informed of the fact that there are loads which are excessive relative to the hooks 11, 12, 13 to which they have been connected and that their movement could therefore be dangerous.

As already mentioned, the telehandler 2 is equipped with an apparatus for controlling the operating arm 2 which includes the hydraulic actuators 26, 27 mounted on the arm and the above-mentioned distributor 25; the invention uses these components for automatically controlling the dangerous conditions connected to the loads suspended from the hooks 11, 12, 13 of the arm 1.

In effect, in this embodiment, the processing unit 4 includes a control module 44 which is connected to the threshold module 42 and is configured for producing a control signal designed to adjust the operation of the distributor 25, as a function of the checks performed by the threshold module 42.

In detail, if the load associated with one or more hooks 11, 12, 13 reaches or exceeds the relative threshold, the processing unit 4 may transmit to the distributor 25 a signal which causes the locking of the movements of the arm 20, or it may also produce a control signal designed to make the arm 20 perform only retraction and/or lowering movements.

The operation of the invention is briefly explained below.

After the operator has connected one or more loads to the hooks 11, 12, 13 of the arm 1, the operator climbs into the cab 24 to manoeuvre the lifting arm 20 which mounts the arm 1 of the invention using suitable commands.

If a load has been connected with an excessive weight to a hook 11, 12, 13, or if the load had has been incorrectly estimated, or an incorrect hook 11, 12, 13 has been used, the system according to the invention signals, for example by means of the display unit 5 and/or a loudspeaker, the potential danger in lifting the load and carrying it to the destination point.

The same applies if a significant load attached to two or more hooks 11, 12, 13 has the barycentre which bears more and too much on the hook which has a lower maximum weight limit.

In addition or alternatively, in the above-mentioned risky conditions, the system prevents the operator from moving the arm 20 by means of the commands in the cab 24.

The invention is also configured as a method for the safe use of an arm with two or more hooks mounted on or to be mounted on an operating arm 20 of a telehandler 2; in detail, the method may be actuated by means of the arm with two or more hooks 1 described above.

In general terms, the method comprises the steps of hanging one or more loads from one or more hooks 11, 12, 13 of said arm 1; and measuring the weight of the suspended load or loads.

Moreover, the method includes steps which correspond to all or some of the functions offered by the arm 1 and by the system according to the invention, as described above.

More specifically, the method proposed may provide an operator with information representative of the weight of the loads.

Moreover, there can be the step of checking, for one or more hooks 11, 12, 13, whether the weight of the load carried by them exceeds or not a respective risk threshold as a function of the maximum weight value which they are designed to support.

In this case, there can advantageously be the step of producing an alarm warning directed to the operator, following the verification that the weight carried by one or more hooks 11, 12, 13 is equal to or greater than the respective above-mentioned risk threshold.

Moreover, it is possible to adjust the operation of what was defined above as apparatus for controlling the operating arm, which substantially includes the distributor and the hydraulic cylinders of the arm, depending on the fact that the load carried by one or more hooks 11, 12, 13 reaches or exceeds the respective risk threshold.

More specifically, it may be established that the movements of the arm 20 are blocked when the load carried by one or more hooks 11, 12, 13 has reached or exceeded the respective risk threshold.

In addition or alternatively, the operating arm 20 may be made to perform retraction and/or lowering movements, when the load carried by one or more hooks 11, 12, 13 has reached or exceeded the respective risk threshold.

The invention also comprises a further embodiment which allows additional advantages to be obtained.

In detail, this embodiment makes it possible to automatically vary the load diagram applied by the processing unit to the movements of the operating arm, as a function of the various operating conditions of the arm.

To be precise, the processing unit 4 firstly includes a plurality of load diagrams recorded in the memory module.

In this case, the control module is configured for limiting the operational possibilities of the control apparatus 25, 26, 27, on the basis of a load diagram and the processing unit 4 also comprises a selection module 45 configured for automatically selecting from the memory module 43 a load diagram on the basis of signals acquired by suitable sensors.

It will be understood that in order to maximise the safety and the operational effectiveness of the arm 1, the processing unit 4 can consider one or more of the following parameters relative to the specific operating condition: weight measured by the load sensors, which hook or hooks the load is suspended from, the position of the arm, if it is of the variable configuration type and where the barycentre of the suspended load is located.

Yet more in detail, the processing unit 4 comprises an identification module, configured to determine which hook(s) is/are stressed by 46 respective loads as a function of the signals produced by the respective load sensors 31, 32, 33; in this case, the selection module 45 is designed to select a relative load diagram from the memory module 43 on the basis of which hook(s) 11, 12, 13 is/are stressed.

Moreover, the processing unit 4 can comprise a weight module 47 configured for calculating the weight values supported by the hooks as a function of the signals acquired from the load sensors 31, 32, 33; in this case, the selection module 45 is designed to select a load diagram from the memory module 43, based on the weight values measured.

Further, the processing unit can include a barycentre module 48 configured to calculate a position of the barycentre of a load hanging from the hooks as a function of which the hook(s) are stressed by respective loads and weight values supported by the hooks; in this case, the selection module 45 is designed to select a load diagram from the memory module 43, based on said position of the barycentre.

The position of the barycentre may be calculated as a function of any reference, preferably integral with the machine.

If the arm 1 is movable between a plurality of configurations, for example it can be extended and/or rotated, then the system according to the invention includes at least one position sensor (not illustrated) designed to detect the current configuration of the arm 1 and to transmit a position signal to the processing unit 4.

In this case, the processing unit 4 includes a position module 49 designed for detecting the configuration of the arm 1 as a function of the position signal and the selection module 45 is designed to select a load diagram from the memory module 43, on the basis of the configuration of the arm 1 detected.

In practice, the invention overcomes the limitations of the prior art where the choice of the suitable diagram is still left to the operator, depending on the hook which the operator wants to load or the configuration in which the operator wants to use the accessory 1.

In detail, the invention avoids not only the risks of error in the selection of the load diagram to be applied, but also prevents the operator from using a diagram which is too permissive with respect to the specific operating conditions of the arm.

For example, when a voluminous load is hung simultaneously on more than one hook 11, 12, 13, the invention prevents the operator from being forced to select a diagram which is or is not safe in order to protect from overloading or from being excessively conservative and causing loss of performance in terms of arm extension and manoeuvring.

In effect, the processing unit 4 according to the invention makes it possible to immediately know the weight of the loads on each hook 11, 12, 13 and the relative positions and is therefore able to calculate the value of the total load and the actual position of its barycentre, with the result of being able to automatically select the load diagram most suitable for maximising safety and performance.

The invention claimed is:

1. A coupling system comprising an arm (1) comprising a supporting beam (10) designed to be connected to an operating arm (20) of a telehandler (2) or another self-propelled operating machine, the arm comprising a plurality of hooks (11, 12, 13), distributed along said beam (10), each designed for supporting a respective load, characterised in that one or more of the hooks (11, 12, 13) is connected to a load sensor (31, 32, 33) designed to produce a load signal as a function of the weight of the load supported by the respective hook, the load sensors are connected to an electronic processing unit (4) comprising a threshold module (42) configured for checking whether the load carried by the one or more of the hooks (11, 12, 13) exceeds or not a respective risk threshold as a function of the maximum weight value which they are designed to support.

2. The system according to claim 1, wherein each hook (11, 12, 13) is connected to a respective load sensor (31, 32, 33).

3. The system according to claim 2, wherein the processing unit (4) includes: at least one memory module (43) in which is recorded a plurality of loading diagrams and a selection module (45) configured for selecting from the memory module (43) a loading diagram based on signals acquired from sensors (31, 32, 33); a control module (44)

being configured for limiting the operational possibilities of a control apparatus (25, 26, 27), based on the loading diagram selected.

4. The system according to claim 3, wherein the processing unit (4) comprises an identification module, configured to determine which hook(s) is/are stressed by respective loads as a function of the signals produced by the respective load sensors (31, 32, 33), said selection module being designed to select a relative load diagram from the memory module (43) on the basis of which hook(s) (11, 12, 13) is/are stressed.

5. The system according to claim 4, wherein the processing unit (4) comprises a weight module (47) configured for calculating the weight values supported by the hooks as a function of the signals acquired from the load sensors (31, 32, 33), the selection module (45) being designed to select a load diagram from the memory module (43), based on the weight values measured, and wherein the processing unit (4) includes a barycentre module (48) configured to calculate a position of the barycentre of a load hanging from the hooks as a function of which the hook(s) are stressed by respective loads and weight values supported by the hooks, the selection module (45) being designed to select a load diagram from the memory module (43), based on said position of the barycentre.

6. The system according to claim 3, wherein the processing unit (4) comprises a weight module (47) configured for calculating the weight values supported by the hooks as a function of the signals acquired from the load sensors (31, 32, 33), the selection module (45) being designed to select a load diagram from the memory module (43), based on the weight values measured.

7. The system according to claim 3, wherein the arm (1) is movable between a plurality of configurations, and the system includes at least one position sensor designed to detect the current configuration of the arm (1) and to transmit to the processing unit (4) a position signal, wherein the processing unit (4) includes a position module (49) designed for detecting the configuration of the arm (1) as a function of the position signal, the selection module (45) being designed to select a load diagram from the memory module (43), based on the configuration of the arm (1) detected.

8. The system according to claim 1, comprising a communication device (5) connected to the processing unit (4) and designed to supply to an operator of said telehandler (2) information on the load(s) supported by the arm (1), wherein said processing unit (4) comprises an information module (41) configured to produce information signals designed to control the device in such a way that it shows the operator load information as a function of the measurements taken by the load sensors (31, 32, 33).

9. The system according to claim 8, wherein said information module (41) is subject to said threshold module (42) and is configured for producing information signals designed to produce alarm warnings directed to the operator in an information device (5), following the verification that the weight carried by one or more hooks (11, 12, 13) has reached or exceeded a respective risk threshold.

10. The system according to claim 1, comprising an apparatus (25, 26, 27) for controlling the above-mentioned operating arm (20), wherein the processing unit (4) includes a control module (44) configured for producing a control signal designed to adjust the operation of said control apparatus (25, 26, 27) as a function of the inspections performed by the threshold module (42).

11. The system according to claim 10, wherein the control module (44) is configured for producing a control signal designed to block movements of the arm (20) by the control apparatus (25, 26, 27).

12. The system according to claim 10, wherein the control module (44) is configured for producing a control signal designed to make the arm (20) perform retraction and/or lowering movements by the control apparatus (25, 26, 27).

13. The system according to claim 10, wherein the control apparatus includes an electro-hydraulic distributor (25) designed to control hydraulic cylinders (26, 27) for moving the arm as a function of control signals received.

14. A telehandler (2) equipped with a system according to claim 1.

15. A method for using an arm with several hooks (1) mounted on or to be mounted on an operating arm (20) of a telehandler (2), comprising the following steps:

suspending one or more loads from one or more hooks (11, 12, 13) of said arm (1);

detecting the weight of the suspended load or loads; checking for one or more hooks (11, 12, 13) whether the load carried by them exceeds or not a respective risk threshold as a function of the maximum weight value which they are designed to support.

16. The method according to claim 15, wherein an operator is supplied with information representing said weight of the load or loads.

17. The method according to claim 16, comprising the step of producing an alarm warning directed to the operator, following the verification that the weight carried by one or more hooks (11, 12, 13) is equal to or greater than the respective above-mentioned risk threshold.

18. The method according to claim 15, wherein a device is provided for controlling the above-mentioned operating arm (20), the method comprising the step of adjusting the operation of a control apparatus (25, 26, 27) of the arm (20) according to whether the load carried by one or more hooks (11, 12, 13) reaches or exceeds the respective risk threshold.

19. The method according to claim 18, wherein the movements of the arm (20) are blocked by the control apparatus (25, 26, 27), when the load carried by one or more hooks (11, 12, 13) has reached or exceeded the respective risk threshold.

20. The method according to claim 18, wherein the operating arm (20) is made to perform retraction and/or lowering movement, when the load carried by one or more hooks (11, 12, 13) has reached or exceeded the respective risk threshold.

* * * * *